US006319561B1

(12) United States Patent
Bernard

(10) Patent No.: US 6,319,561 B1
(45) Date of Patent: Nov. 20, 2001

(54) METHOD FOR APPLYING JET-SPRAYED DECORATION TO FABRIC

(76) Inventor: Andre Bernard, 5 Kitchel Rd., Mr. Kisco, NY (US) 10549

( * ) Notice: Subject to any disclaimer, the term of this patent is extended or adjusted under 35 U.S.C. 154(b) by 11 days.

(21) Appl. No.: 09/596,870

(22) Filed: Jun. 19, 2000

(51) Int. Cl.[7] ..... B05D 1/02; B05D 1/32

(52) U.S. Cl. ..... 427/466; 427/267; 427/282; 427/288; 427/300; 427/421; 427/424; 118/504; 118/505; 68/205 R; 15/307

(58) Field of Search ..... 427/466, 261, 427/262, 267, 282, 288, 300, 421, 424; 118/504, 505; 156/387; 68/205 R; 15/307

(56) References Cited

U.S. PATENT DOCUMENTS 5,838,343 * 11/1998 Chapin et al. ..... 347/22

5,867,197 * 2/1999 Aoki ..... 347/106

* cited by examiner

*Primary Examiner*—Shrive P. Beck
*Assistant Examiner*—Jennifer Calcagni
(74) *Attorney, Agent, or Firm*—Myron Amer P.C.

(57) ABSTRACT

In the jet straying of ink droplets in a decorative pattern onto a fabric during which a jet spray head shuttles across the fabric changing directions at opposite selvage edges, the provision in an interposed position between the spray head and upstanding selvage edge fibers of shields preventing contact therebetween which maintains bubble closures over exit openings in the jet spray head intact and obviates inadvertent gravity flow of ink as might mar the decorative pattern.

1 Claim, 2 Drawing Sheets

METHOD FOR APPLYING JET-SPRAYED DECORATION TO FABRIC

The present invention relates generally to fabric decoration using ink jet spraying apparatus and processes and, more particularly, to accommodating the operating mode of the apparatus to the characteristics of the fabric to contribute to achieving more effective decoration of the fabric.

EXAMPLES OF THE PRIOR ART

Decorating fabric preparatory to manufacture into garments, and other end uses is achieved by dying, roller printing and, currently by the technique, now of choice which uses ink jet spraying apparatus described and illustrated in many prior patents, two such exemplary patents being U.S. Pat. No. 5,687,197 for "Ink-Jet Printing Cloth, Ink-Jet Printing Process And Production Process Of Print" issued to Aoki on Feb. 2, 1999 and U.S. Pat. No. 5,847,739 for "Cloth Feeding Drum For Ink-Jet Printing" issued to Kanaya et al. on Dec. 8, 1998. The noteworthy decorative results apparently warrant the use of jet spraying despite its intricacies, as perhaps best expressed in the '739 patent at col. 1, in lines 49–52 that "In order to accurately form line and delicate patterns with ink jet printing, the distance between the ink jet nozzle and the cloth surface must be kept constant while the nozzle head is moving along the width of the cloth, and the cloth printing surface must be substantially flat."

If an unsatisfactory decorative pattern is produced, the effort, even by those well versed in the art, is to seek correction in the parameters above noted, namely in adjustments in the distance between the ink jet nozzle and the cloth surface, or in the tracking of the nozzle head and so on. Even with such adjustments however, inexplicable unsatisfactory decorative results still persist, and the solution remains elusive.

Broadly, it is an object of the present invention to minimize unsatisfactory decorative results by not limiting corrective techniques to operating parameters of the apparatus, as is now done and is a major shortcoming of the prior art.

More particularly, it is an object of the present invention to achieve a synergism of the jet spraying apparatus and of the fabric being decorated which minimizes the heretofore inexplicable unsatisfactory decorative results, all as will be better understood as the description proceeds.

The description of the invention which follows, together with the accompany ing drawings should not be construed as limiting the invention to the example shown and described, because those skilled in the art to which this invention appertains will be able to devise other forms thereof within the ambit of the appended claims.

DESCRIPTION OF THE PREFERRED EMBODIMENTS

Figure 1:
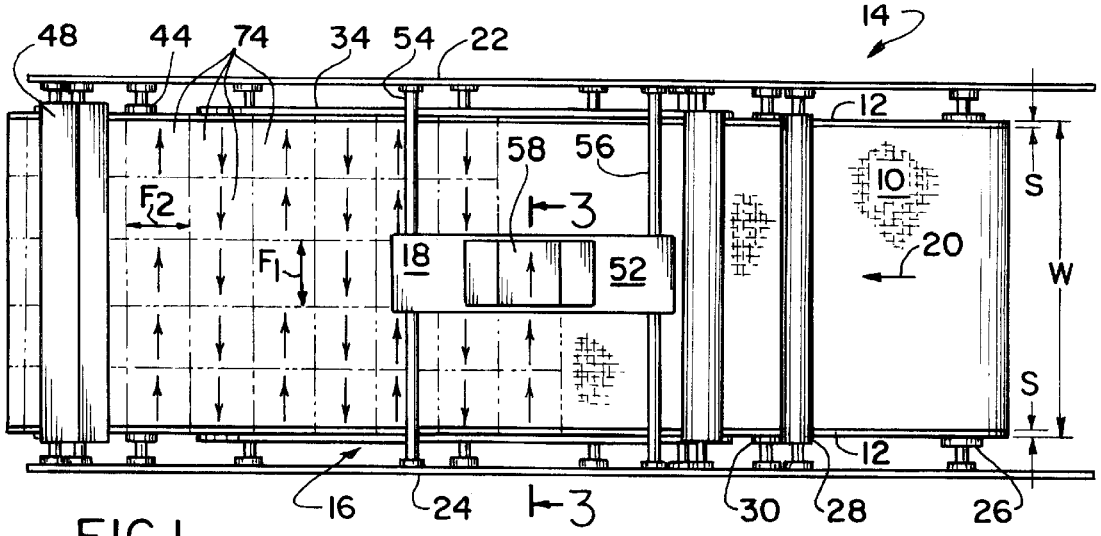
FIGS. 1 is a plan view of an ink jet fabric-printing apparatus.

In the drawing figures, a flat woven fabric or web 10 suitable for the manufacture of garments, upholstery and many other items is shown in whole or in part. Web 10 is conventionally manufactured to a standard width W (FIG. 1) with standard selvage edges 12 of a width S along each edge. Warp threads used in the selvage are of stronger and coarser material than those used in the balance of the web. This coarseness is the origin of the problem to be solved, all as will be better understood as the description proceeds.

Figure 2:
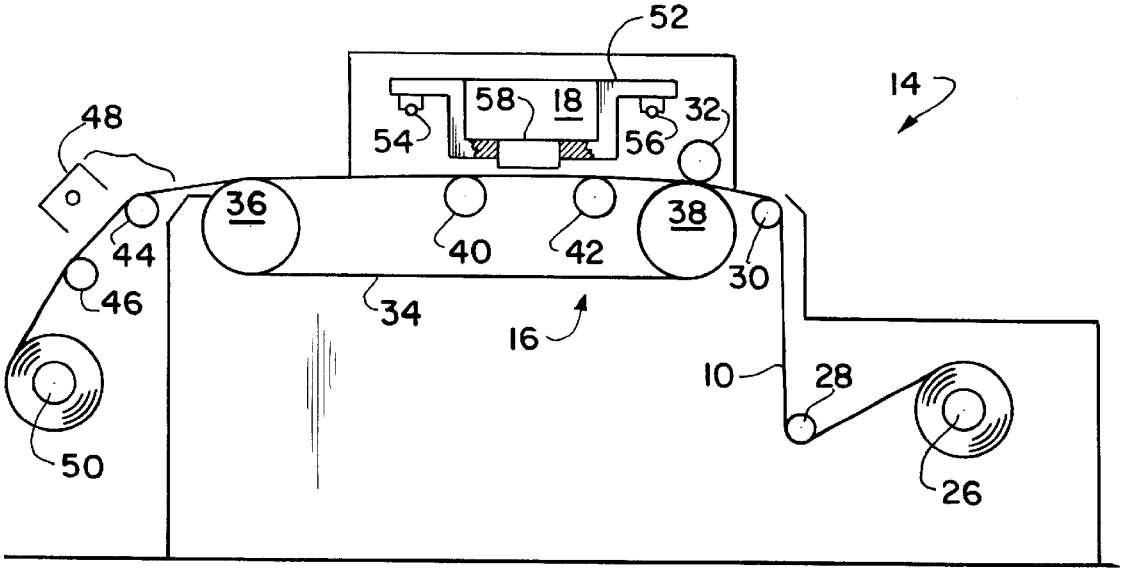
FIG. 2 is a side elevational view projected from FIG. 1.

In FIGS. 1 and 2, ink jet printing, apparatus or machinery 14 consists of a conveyance section 16 and a printing section 18. As seen looking downstream, a direction depicted by arrow 20, sections 16 and 18 are mounted on a right side chassis wall 22 and a left side chassis wall 24.

In the conveyance section 16, web 10 is initially put up on feed roller 26 and led past rollers 28, 30 and 32 all of which insure proper tracking of web 10. At roller 32, web 10 contacts endless belt 34 which is entrained about conveyance rollers 36 and 38. Platen rollers 40 and 42 further insure that web 10 aligns or tracks properly in relation to print section 18. After passing over conveyance roller 36, web 10 passes over heater rollers 44 and 46 past heater 48 and on to take-up roller 50.

Figure 3A:
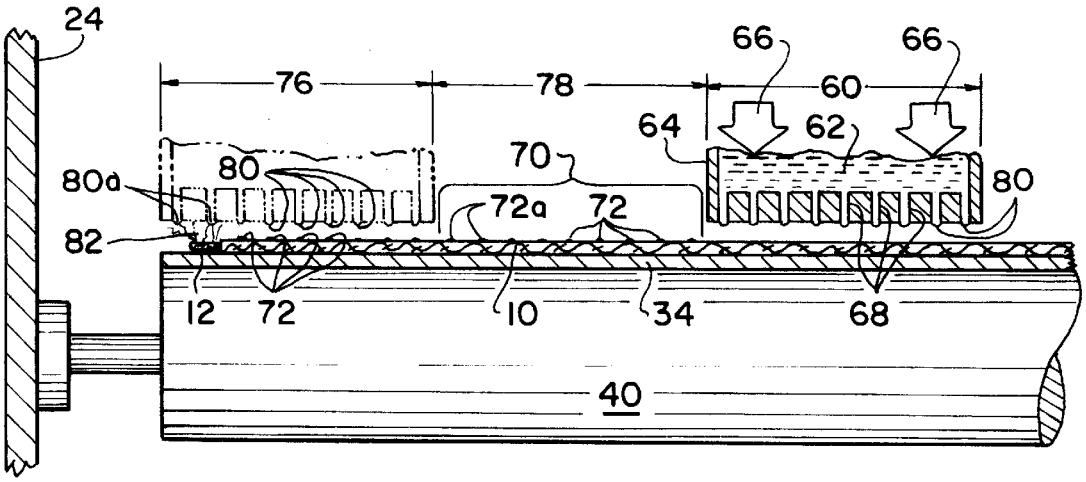
FIG. 3*a* is a first sectional view taken along line 3—3 of FIG. 1.

The printing section 18 consists of a carriage 52 mounted on spanning rails 54 and 56. Carriage 52 supports print head 58. As shown in simplified form in FIG. 3*a*, as below reference 60, a supply of ink 62 is contained in housing 64 under pressure 66. A multitude of minute orifices 68 formed by techniques known to the industry are employed to deliver a desired pattern 70 of ink droplets 72 onto the web 10. The process of delivering each droplet 72 to web 10 utilizes the well known in the art "bubble jet system", as described and illustrated in numerous prior patents as exemplified by U.S. Pat. No. 5,867,197 issued on Feb. 2, 1999, wherein each orifice 68 is operatively associated with an internal electro thermal converter so as to be pulsed at the appropriate time resulting in the ejection of droplet 72 onto web 10.

As seen best in FIG. 1, carriage 52 is urged in movement laterally a distance $F_1$ after each ink ejection, N number of times to form a lateral course. At the end of each course, web 10 is advanced a distance $F_2$ in direction 20. The combination of intermittent motions $F_1$ and $F_2$ results in the printing of repetitive pattern frames individually and collectively designated 74 over the surface or body of web 10. Because of the very small size of the orifices 68 within print head 58, a high density of droplets 72 are deposited on web 10. Additionally, by providing multiple print heads 58 on carriage 52 the decoration of the web surface 10 can be embodied with a variety of colors and patterns 70.

Figure 3B:
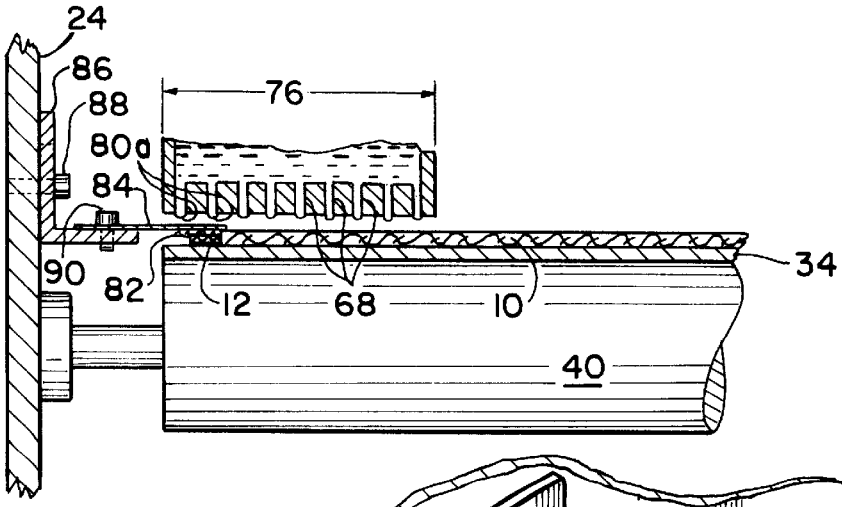
FIG. 3*b* is a second sectional view taken along line 3—3 of FIG. 1.
Figure 4:
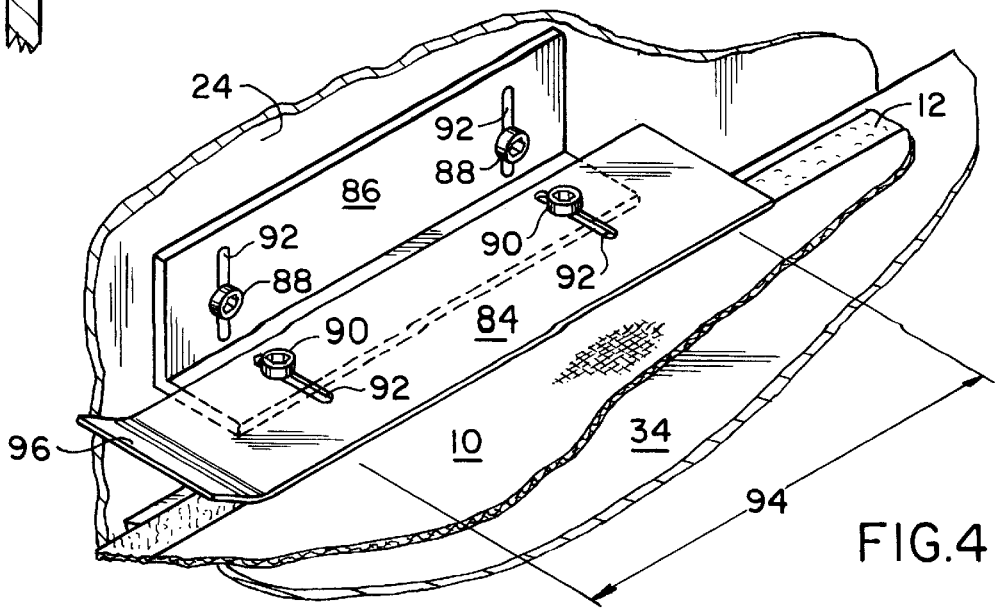
FIG. 4 is an isolated perspective view on an enlarged scale of a component illustrated in FIG. 3*a*.

Referring to FIG. 3*b*, where part of a typical lateral sequence is shown in elevation, print head 58 is shown in phantom line perspective at position 76 at which location it will be understood to have deposited droplets 72, reformed bubbles 80 as closures over the orifice openings 68 and moved to position 78. In position 78, print head 58 continues to provide an ink droplet deposited pattern 70, followed by reformed bubbles 80 and moves on to position 60, and so on.

A problem heretofore elusive to those in the art, arises within selvage edge 12 at which upstanding fibers 82 brush against newly formed bubbles 80*a*. Fibers 82 are characteristic of the previously mentioned warp threads used within selvage 12. In the ink jet process a combination of pressure, ink viscosity and surface tension cause a bubble to form as a closure over the outlet of each orifice 68 prior to the ejection of droplets 72 on the next adjacent frame 74. However, it is theorized that when fibers 82 snag bubbles 80*a* in position 76, droplets 72*a* are imperfectly formed at position 78 and gravity flow of ink droplets from the orifices

58 onto the web 10 mar the decorative pattern printed on the web 10. Stated somewhat differently, it is because the fibers 82 are not present at position 78 that bubbles 80a are still intact when print head 58 reaches position 60, which results in a satisfactory frame 60. The phenomenon theorized is borne out by inspection of otherwise inexplicable unsatisfactory decorative patterns and satisfactory decorative patterns following obviating the phenomenon, as will now be described. The same problem arises when print head 58 is over the right selvage edge 12, and similarly is solved by preventing premature bursting of the bubble 80*a* closures over the orifices 68.

In FIG. 3*b*, print head 58 is shown in position 76 ready to deposit a print pattern 70 on web 10. In accordance with the present invention, a thin blade 84 is mounted in an interposed position between bubbles 80*a* and selvage 12 such that fibers 82 are shielded or restrained from contacting the bubbles 80*a*. Blade 84 is mounted in cantilever fashion on bracket 86 which, in turn, is secured to wall 24 with suitable fastening means 88. Likewise blade 84 is held in position on bracket 86 by fastening means 90. Elongated slots 92 in bracket 86 and blade 84 allow for vertical and horizontal positioning. The overall length of blade 84 should be greater than the effective length 94 which is equivalent to frame length $F_2$. The leading end 96 of blade 84 should be turned upward to avoid snagging web 10 and selvage 12.

It will be understood that a similar shield 84 is provided over the right selvage edge 12 being mounted on wall 22 and, for brevity sake will not be described, being denoted by the same reference numbers.

From what has been described, it should be readily understood that the operating mode of the jet spraying of a decorative pattern onto the woven fabric 10 contemplates the steps of (1) urging the jet spray head 58 in alternating movements between opposite selvage edges 12 transversely across the fabric 10 on a horizontally oriented plane at a selected clearance above the fabric surface to be decorated, and (2) intermittently applying and not applying pressure on a source of ink so as to cause during a pressure application the exiting flow of ink droplets 72 through microscopic openings 68 of the jet spray head 58 onto the fabric surface 10 to be decorated. As further explained, for proper control of the exiting flow of the ink in droplets 72, there occurs a phenomenon during a non-application of pressure of a formation of plural bubble closures 80 over the microscopic openings 68 of the jet spray head 58 as caused by fluid surface tension of the ink within the microscopic openings 68, i.e., a surface tension that must be overcome by the next application of pressure before the ink droplet 72 can exit.

The problem which occurs, and which was elusive to those in the art, was the premature bursting of the bubble closures 80 upon the unavoidable contact of these bubbles by the upstanding selvage fibers 82 which, upon this happenstance, resulted in the gravity flow of the ink from the spray head 58 otherwise than in response to and in coordinated relation to applied pressure of the well known "bubble jet system" of prior patents as exemplified by the noted '197 patent. Shielding the bubble closures 80 against this contact with the selvage fibers 82 by the simple expedient of providing an interposed position of a shield 84 between the spray head 58 and upper ends of the fibers 82 has resulted in practice in achieving improved jet-sprayed decoration by the obviating of a heretofore elusive source of decorative irregularities.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In a method of jet spraying a decorative pattern onto a fabric woven with opposite selvage edges delimiting therebetween a body with a surface receiving deposits of patten-forming droplets of ink exiting under pressure through microscopic openings of a jet spray head, the improvement comprising the steps of:

A. urging said jet spray head in alternating movements between said opposite selvage edges transversely across said fabric on a horizontally oriented plate at a selected clearance above said body surface;

B. intermittently applying and not applying pressure on a source of ink so as to cause,during a pressure application, the exiting flow of ink droplets through said microscopic openings of said jet spray head onto said body surface;

C. allowing, during a non-application of pressure, a formation of plural bubble closures over said microscopic openings of said jet spray head as cause by fluid surface tension of said ink; and D. supporting a contacting-blocking shield in a plane below said horizontal movement plane of said jet spray head and in cantilever relation over said opposite selvage edges;

whereby said shield has an interposed position between any free ends of upstanding fibers of said selvage and obviates the contacting thereof with said bubble closures as might result in the undesirable gravity flow of ink from said jet spray head and the bursting of said bubble closures other than by applied pressure on said source of ink.

* * * * *